US008627694B2

(12) United States Patent
Schreiber

(10) Patent No.: US 8,627,694 B2
(45) Date of Patent: Jan. 14, 2014

(54) METHOD AND DEVICE FOR BENDING SHEET METAL SECTIONS

(75) Inventor: Peter Schreiber, Bargen (CH)

(73) Assignee: Soudronic AG, Bergdietikon (CH)

( * ) Notice: Subject to any disclaimer, the term of this patent is extended or adjusted under 35 U.S.C. 154(b) by 564 days.

(21) Appl. No.: 12/601,533

(22) PCT Filed: Apr. 17, 2008

(86) PCT No.: PCT/CH2008/000173
§ 371 (c)(1),
(2), (4) Date: Jan. 15, 2010

(87) PCT Pub. No.: WO2008/144946
PCT Pub. Date: Dec. 4, 2008

(65) Prior Publication Data

US 2010/0154500 A1 Jun. 24, 2010

(30) Foreign Application Priority Data

May 30, 2007 (CH) ..... 862/07

(51) Int. Cl.
*B21C 51/00* (2006.01)
*B21D 5/14* (2006.01)

(52) U.S. Cl.
USPC ..... 72/17.3; 72/11.1; 72/170; 228/17.5

(58) Field of Classification Search
USPC ..... 72/31.07, 8.3, 11.1, 17.3, 173, 174, 72/170, 166, 368, 379.4, 15.3; 228/17.5, 228/144
See application file for complete search history.

(56) References Cited

U.S. PATENT DOCUMENTS

| | | | | |
|---|---|---|---|---|
| 3,851,376 | A | 12/1974 | Gross et al. | |
| 5,187,959 | A * | 2/1993 | Davi | 72/10.6 |
| 5,209,625 | A | 5/1993 | Stieger | |
| 5,497,935 | A | 3/1996 | Gravier | |

FOREIGN PATENT DOCUMENTS

| | | |
|---|---|---|
| DE | 2 221 776 | 11/1973 |
| DE | 33 30 171 A1 | 2/1984 |
| EP | 0 477 752 A1 | 4/1992 |
| GB | 2 126 132 A | 3/1984 |

OTHER PUBLICATIONS

International Search Report forPCT/CH2008/000173.

* cited by examiner

*Primary Examiner* — Debra Sullivan
(74) *Attorney, Agent, or Firm* — McCormick, Paulding & Huber LLP

(57) ABSTRACT

During the bending of sheet metal sections (1, 2) for forming can bodies by means of a bending machine, the sheet metal characteristics of the individual sheets are measured, e.g. the thickness and/or the strength of the sheets. The measured value is used to control the bending machine (4). This permits a substantially constant bending result to be achieved, even with varying sheet metal characteristics.

16 Claims, 5 Drawing Sheets

METHOD AND DEVICE FOR BENDING SHEET METAL SECTIONS

CROSS-REFERENCE TO RELATED APPLICATIONS

This application claims the priority of Swiss patent application No. 00862/07, which was filed on May 30, 2007 and PCT application No. PCT/CH2008/000173, which was filed Apr. 17, 2008 and of which the entire disclosures are hereby included by reference.

BACKGROUND OF THE INVENTION

The invention is related to a method for rounding single metal sheet sections to form container body blanks as well as a method for manufacturing can bodies out of single metal sheet sections. Furthermore, the invention is related to a rounding machine for rounding single metal sheet sections as well as a welding device for can bodies with such a rounding machine.

PRIOR ART

Methods and devices of said type are used in the production of container bodies, particularly can bodies, of metal sheet. For this, after the rounding the container body blanks are transported directly into a welding machine for welding the longitudinal seam of the body. Thereby, the destacking of the metal sheets, the rounding apparatus and the welding machine normally form an entity. Corresponding systems for the production of cans are for example known from DE-A-33 30 171 or from U.S. Pat. No. 5,209,625. There, the rounding takes place in such a way, that the formed can body can be guided directly into the Z-rail used for the seam overlapping. For the rounding, the metal sheet sections, cut rectangularly, with defined dimensions and material characteristics recorded in standards, are pushed by a feeding system into a first driven transport roller pair, are transported further by multiple driven transport rollers with a speed of 100-450 m/min. and are bent to a round body blank in a rounding machine with a rounding system, by means of wedges with rollers or with roller systems. Optionally and additionally, a plastic deformation serving for stress relief in the metal sheet takes place in advance before the rounding by means of a wedge system of an optional flexer station. Such rounding machines or installations respectively are known to the skilled person. Depending on the quality of the metal sheet, the metal sheets produced in series have different sheet thicknesses and material characteristics, like yield point, elongation and strength characteristics, which lead to different body blank diameters and therefore to different openings at the free ends after the rounding process. Because thereby not all of the bodies rounded in series lie in the same position within the rounding station and they have different rounding diameters, this can result in variations of the degree of overlapping in the welding station, which is problematic for the welding of the body, or leads to problems during the lateral pushing of the bodies out of the rounding machine into the welding equipment and therefore leads to a machine stop with longer downtimes. The efficiency of the machine is thereby reduced and shortfall costs arise for the machine operator.

It is known from EP-A-477 752, in case of the comparatively very slow forming of single tubes or bodies out of a metal sheet introduced into a rounding machine by an operator, to measure the sheet thickness and/or the yield point or the elongation point and to adjust the position of lateral rounding rollers. Furthermore it is known from DE-A-2 221 776, in case of the forming of a tube with spiral weld seam, to measure the deformation resistance of the strip before the ingress of the metal strip into the strip bending equipment, such that the degree of spring back stays within allowable limits. In case of the rounding and welding of can bodies, which take place with said very high speed, the shown approaches are not applicable.

SUMMARY OF THE INVENTION

In order to avoid said problems when rounding and welding can bodies, today it is preferred to use sheets with low variations in material characteristics and if possible from only one manufacturing series of the metal sheet producer. A mixing of different metal sheets is preferably avoided. The rounding needs to be checked often and if needed the rounding system must be readjusted.

It is the task of the invention to avoid these disadvantages.

This is reached by the method mentioned in the preamble by measuring at least a metal sheet characteristic which influences the rounding before and/or in the feed section and/or in the rounding machine, by providing the measurement value or a value derived from it to the control of the rounding machine, and by controlling the rounding machine depending on the measurement value or the derived value in such a way, that the rounding diameter (R) of the body is held substantially constant even in case of a changing metal sheet characteristic.

Within the devices mentioned in the preamble, the task is solved in such a way, that at least a measurement device is provided, by means of which at least one metal sheet characteristic can be measured, that a measurement value of the measurement device or a value derived from it can be given to a controller of the rounding machine, and that the rounding machine can be controlled depending on the measurement value or the value derived from it, such that a substantially constant rounding diameter can be reached in case of changing metal sheet characteristics.

Within a preferred method or device respectively, the measuring is carried out non-destructively during the rounding process, at consecutive metal sheet sections, thus such that measurement takes place during the running rounding operation and the rounding is adjusted according to the measurement. The rounding takes place in case of forming can bodies and particularly with a speed of 100 up to 450 m/minute and the rounded container body blanks are fed out of the rounding machine into a welding device for can bodies having welding rollers, particularly with intermediary wire electrodes running on it, and a Z-rail for the positioning of the body edges. As metal sheet characteristic the metal sheet thickness can be measured.

Preferably, the rounding characteristic is directly measured as the metal sheet characteristic, such that a direct measurement for the behaviour of a single or of each metal sheet section is gained. This can take place in such a way, that a partial pre-rounding is carried out in the feed section or that a partial pre-rounding is carried out in the rounding machine, particularly in the flexer station, and that the rounding characteristic is measured electrically and/or mechanically and/or optically and/or acoustically.

Alternatively, the strength of the metal sheet sections can be measured as metal sheet characteristic. Thereby, an indirect measurement for the behaviour during the rounding or for the adjustment of the rounding machine respectively, can be gained. The strength can be measured by magnetising the metal sheet and subsequent measurement of the gradient of the remnant field strength and its correlation with strength values, particularly tensile strength and/or yield point, of the metal sheet, or the strength can be measured by producing and measuring eddy currents in the metal sheet and their correlation with strength values, particularly tensile strength and/or yield point.

At least one of the rounding rollers of the rounding machine and/or a rounding wedge of the rounding machine is controlled by the measurement value or the derived value. Additionally or alternatively, a pre-rounding wedge of the rounding machine may be controlled by the measurement value or the value derived from it. Furthermore, a flexer station of the rounding machine, particularly a flexer wedge arranged therein, may be controlled by the measurement value or the derived value.

BRIEF DESCRIPTION OF THE DRAWINGS

Further embodiments, advantages and applications of the invention result from the dependent claims and from the now following description by means of the figures.

DESCRIPTION OF THE PREFERRED EMBODIMENTS

Figure 1:
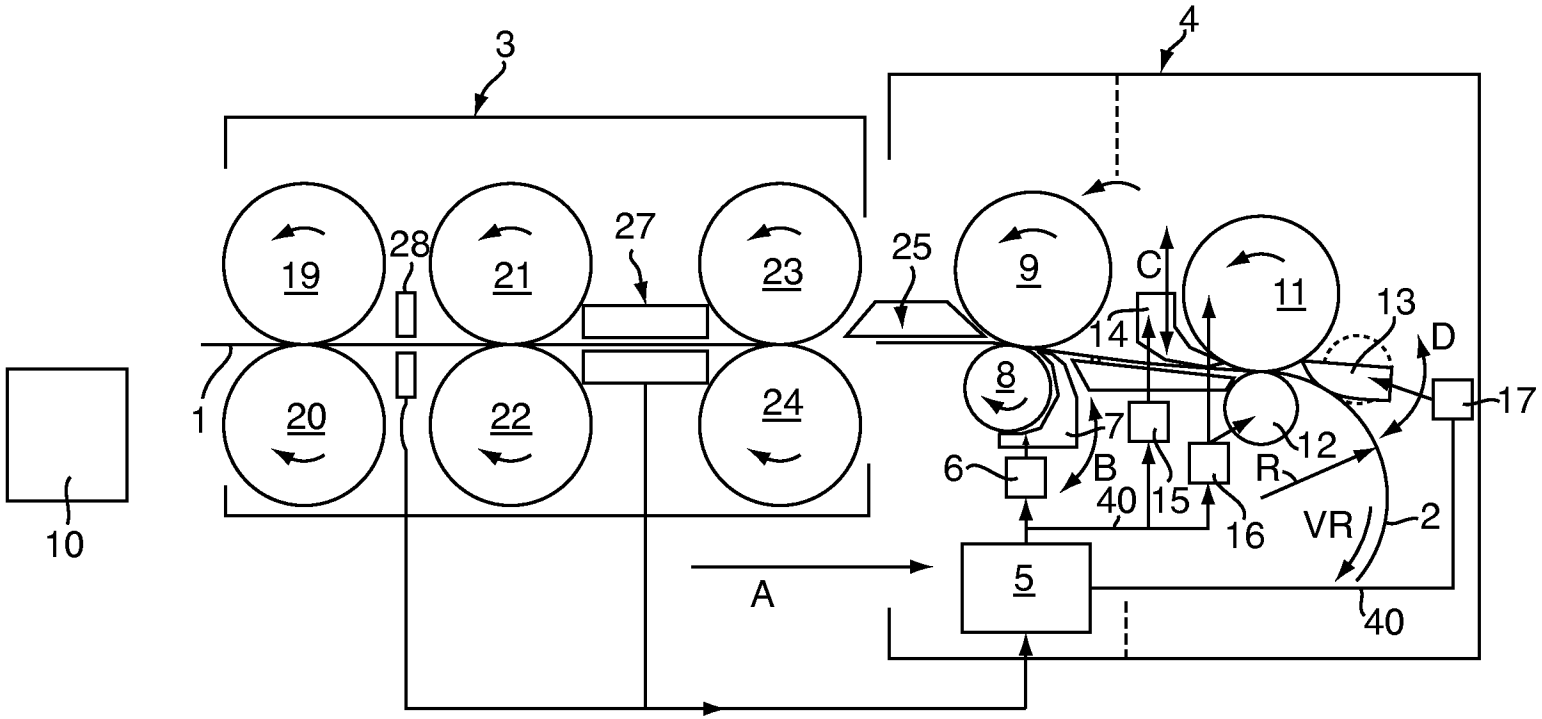
FIG. 1 schematically shows a device for explaining first embodiments of the invention.

FIG. 1 shows schematically in a side view different embodiments of the present invention. Thereby it is evident that metal sheet sections, of which the sections 1 and 2 are represented as examples, are destacked from a stack 10 and fed into a transport device 3, which serves as feed line for a rounding machine 4. Thereby the metal sheets traverse this arrangement of feed section and machine in the direction of the arrow A. The destacking from the stack 10 and the bringing in into the transport device 3 is not being explained here, as it is known to the skilled person. The transport device 3 is furthermore to be seen as facultative, even though preferred, such that the metal sheets may also be passed directly from the stack 10 into the rounding machine 4. Then, this requires that the measurement installation, which is subsequently explained, is positioned at the entrance of the rounding machine 4 or inside of it, which will also be shown in more detail. An arrangement of the measurement device in the rounding machine 4 or at its entrance is evidently possible as well if a transport device is present. In the shown embodiment, the transport device 3 is equipped with a plurality of roller pairs 19, 20; 21, 22 and 23, 24, which convey the respective metal sheet section to the entrance 25 of the rounding machine 4. This conveying may also be executed in a different way than with the shown roller pairs, as known to the skilled person. In the rounding machine 4, each metal sheet section is rounded to a body blank, as it can be seen for the front part, in feed direction, of the metal sheet section 2. Thereby, the rounding takes place with a nominal rounding diameter, predefined by the setting of the rounding machine, and leads to the rounding diameter R; this with a rounding speed VR of for example 100 to 450 m/minute. Rounding machines are known in various embodiments, also particularly for can bodies, whereby the rounding machine may be provided in a simple form as two-roller rounding machine with the two rollers 11 and 12. Equally, rounding machines with a plurality of rollers are known, such for example from EP-A-1 197 272. Such rounding machines can be used as well within the scope of the present invention, as well as any other rounding machines; according to the invention they have to be controllable in their setting for the predefinition of the rounding during the rounding process, as this will be explained in more detail. In the present embodiment it is shown that a pre-rounding wedge 14 may be provided prior to the rounding rollers 11 and 12. Equally, a rounding wedge 13 may be provided after the rounding rollers 11, 12. Furthermore, it is possible and also preferred that a flexer station, which is a part of the rounding machine 4 in the shown embodiment, which however may also be a separate station, is provided before the actual rounding station. In the shown example, the flexer station has the rollers 9 and 8 as well as the flexer wedge 7 which acts upon the metal sheet coming out of the rollers. Flexer stations for the removal of tensions in the metal sheet are known as such to the skilled person, basically for the pre-treatment of the metal sheet and for the simplification of the subsequent rounding, for example from the aforementioned U.S. Pat. No. 5,209,625 and, as such, will not be further explained here; however, the subsequently described measurement device for determining the rounding behaviour in the flexer station may be arranged within the flexer station and use its pre-rounding for determining the rounding behaviour of the metal sheet, which will be explained in more detail.

The adjustable elements of the rounding machine and preferably also the flexer station are provided with drives (subsequently called actuators), which can move these elements, within the scope of their ordinary adjustment capabilities, in order to allow to the controller of the rounding machine an influence on the rounding result; the influence of the actuators on the elements of the rounding machine are symbolized in the figures by arrows starting at the actuators and ending in the respective element, the motion of the element by another arrow, and the connection of the actuators with controller 5 is symbolized by lines 40. In this way, the flexer wedge 7 can be moved by actuator 6 in direction of arrow B. The flexer wedge 14 can be moved by actuator 15 in direction of the arrow C. For the rollers 11 and 12, a drive determining their mutual distance may be provided, which acts upon one or upon both rollers and which is schematically shown as actuator 16. Furthermore, the actuator 17 may act upon the rounding wedge 13 in order to move it according to arrow D. All of these actuators or only one of them may be provided or arbitrary combinations are possible, allowing the controller 5 of the rounding machine 4 to directly influence the rounding result or the rounding diameter respectively, during the operation, via the actuation of the actuators and thereby the setting of the thereby moved rollers and/or rounding wedges. The arrangement of the according motion elements and actuators may vary depending on the actual constructive setup of the rounding machine, however it is evident to the skilled person. The actuators may be based on electromotive, magnetic, pneumatic, hydraulic or piezo-electrical basis, in order to adjust the respective elements of the rounding machine. This shall be possible, as mentioned, during the operation of the rounding machine, in order to cause a change of the rounding diameter by the controller between subsequent metal sheets, and preferably even during the rounding of a metal sheet. For the metal sheet sections of the stack 10, which have certain metal sheet characteristics, the rounding machine is thereby normally operated in a suitable basic setting leading to the desired rounding diameter R when adhering to these metal sheet characteristics. If differing metal sheet characteristics are present, which are measured according to the invention, which will be explained, the controller 5 may serve at least one actuator because of the measurement, in order to adjust the rounding characteristics to measured changed metal sheet characteristics, such that the rounding result with the desired rounding diameter R is again reached. If only one of the actuators is present, for example actuator 17 which acts upon the rounding wedge 13, the change by the controller 5 can be carried out in a simple way, and it may be adjusted or programmed respectively by means of a few test experiments with metal sheets of different characteristic, such that the correct result is reached for these different metal sheets. If subsequently, during the operation, it is detected that a metal sheet with a measurement value is present, which matches to a prior saved value or lies within a prior saved value range for the measurement value, the controller will react according to the test experiments and will provide the according rounding wedge adjustments which lead to the desired rounding result for a metal sheet with this measurement value. It is evident that also the complexity of the command varieties stored in the controller 5 rises with the providing of multiple actuators and therefore multiple influencing possibilities, for example because they decide if, in case of a changing metal sheet characteristic, the observance to the desired diameter R is provided by means of the pre-rounding wedge 14 or the actuator 15 respectively, or more suitable by the actuator 16 and the roller adjustment. This can also be determined by the machine adjusting operator by means of test sheets and the controller can be accordingly adjusted or programmed respectively. The same is valid for the option by which the flexer wedge 7 is adjustable as well by means of an actuator. Because the attainable effects by means of the respective elements 7, 14, 11 and 12 or as the case may be 13, are known by the skilled person for rounding machines, he can offhand program the controller accordingly, such that it can carry out the changes which he would carry out for a certain metal sheet characteristic in a known way by an adjustment when the operation stands still (offline), as well during operation (online) by the actuators.

Figure 4:
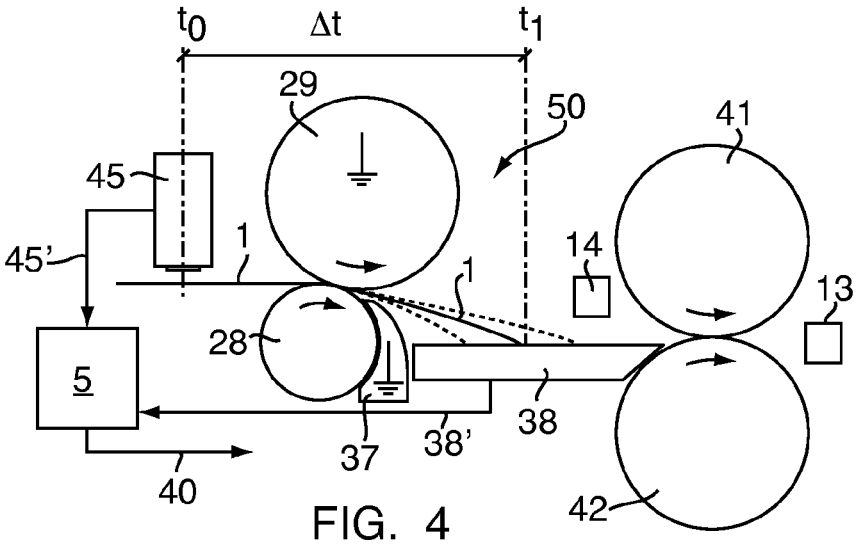
FIG. 4 is a schematical representation of a measurement installation.
Figure 5:
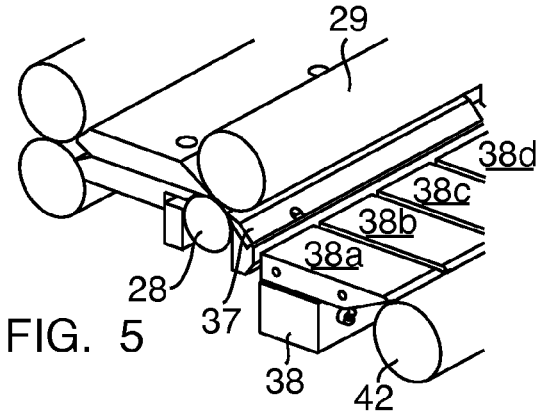
FIG. 5 is a perspective partial representation of the measurement installation of FIG. 4.

According to embodiments of the invention, a measurement device for the metal sheet sections is provided, by means of which at least one characteristic of the respective metal sheet can be taken before rounding, such that the rounding machine is adjusted for the rounding of this metal sheet. The invention also comprises the option to measure at least one metal sheet of a stack 10 before taking on the operation, particularly to measure in a destructive way, in order to measure the metal sheet characteristics of the metal sheets of this stack and to adjust the rounding machine 4 by means of the controller 5 accordingly. Such a measurement device for measuring before the operation is then preferably directly connected to the controller 5 by means of a data link, such that the controller 5 directly receives the measurement value or a value derived therefrom for the characteristic of the metal sheets of the stack. The controller 5 can adjust the rounding machine by means of the actuators accordingly. However, an approach is preferred, whereby a measurement is carried out during the rounding process, as explained in the following. In case of the shown embodiments, both from FIG. 1 and FIG. 2 or 3, a measurement of at least a metal sheet characteristic takes place within the feed section 3, which is formed here by the shown transport device. In case of a lack of such a feed section 3, the metal sheet therefore is provided directly from the stack 10 via a destacker into the entrance area 25 of the rounding machine, where it is taken up and further conveyed by it, thus the measurement of the at least one metal sheet characteristic takes place either at the destacker and/or directly at the entrance or in the rounding machine 4, particularly in the flexer station. For this, the skilled person can offhand arrange the measurement devices described in the following, such that they do not lie in the feed section 3, as shown, but at the destacker and/or at the entrance of the rounding machine or in the rounding machine, particularly in a flexer station of it. Such an example is shown in FIGS. 4 and 5. It is also possible to provide respective measurement devices at the sheet shears which cut large metal sheet plates into the single metal sheet sections. Then it would be possible to mark the metal sheets with a marking showing the measured metal sheet characteristics, for example with a number code or a bar code, such that this code may be read within the feed section 3 or at the entrance of the rounding machine 4 or inside of the same, by means of which the controller is provided with the measurement value or the measurement values or accordingly derived values, allowing the adjustment of at least one of the actuators. In the example shown in FIG. 1, a measurement device 27 lying between the roller pairs 21, 22 and 23, 24 is shown. This measurement installation is connected with the control installation 5, such that the measurement value or a derived value indicating the metal sheet characteristic can be passed to the controller 5. Preferably, the measurement device 27 is a device which allows the measurement of the strength of the respective metal sheet section, in the figure, of the metal sheet 1. For example this is a measurement method working contactlessly. A known contactless measurement, which is used for steel strips and is here newly used for individual metal sheet sections, is based on a periodical magnetising of the metal and the subsequent measurement of the gradient of the remnant magnetic field strength on the upper side and the lower side of the strip or here of the section respectively. The measured value of the remnant magnetic field strength or the computed gradient respectively is assigned to the mechanical strength of the metal sheet section by means of correlation equations, particularly comprising the tensile strength and the yield point of the respective metal sheet. Such a measurement installation is known under the trademark IMPOC® and is available on the market, and is produced and distributed by the company EMG Automation GmbH, Wenden, Germany. By means of such a measurement device it is possible to determine the strength characteristics of the metal sheet sections, which have a direct influence on the rounding characteristics, and the respective measurement value is passed to the controller 5, which operates at least one of the actuators, particularly when increasing or lowering the strength values compared to a pre-set nominal value or nominal value range, in order to adjust the rounding machine during operation to the changed strength values. If the measured strength value for the metal sheet section 1 differs from a pre-set nominal value or nominal value range and is another pre-set value or value range for which the controller has commands for the adjustment of the rounding machine, the controller 5 will operate, for this metal sheet section 1, for example the actuator 17 for the rounding wedge 13 and as the case may be actuator 15 for the pre-rounding wedge 14 as well, after the previous metal sheet section 2 has left the rounding rollers 11, 12, such that the rounding behaviour of the rounding machine is adjusted to the different strength characteristic of metal sheet 1 which is different than for metal sheet 2, such that the desired diameter R results again when metal sheet 1 traverses the rounding machine. It will be proceeded in the same way with subsequent and further following metal sheet sections, such that if needed, an adjustment during the operation for each metal sheet section results. Instead of the mentioned product INPOC®, a commercially available product 3R-AQC by the company 3R Technics GmbH, Zürich, Switzerland, is applicable as well, which also measures metal sheet characteristics in a contactless and non-destructive way, by generating eddy currents in the metal sheet by means of a measurement coil and then again measuring them. From the eddy current measurement, the mechanical strength characteristics of the metal sheet, like rigidity, tensile strength, yield point, may also be measured by means of correlation.

Additionally or instead of the measurement device 27 and of the further measurement installations of the examples according to FIGS. 2 to 6 still to be explained, a measurement device 28 may be provided, which measures the metal sheet thickness of the respective metal sheet section in a way basically known by the skilled person. Such metal sheet thickness measuring devices are also known and commercially available and will not be further explained here. The initial value of the metal sheet measurement is passed on to the controller 5 and is used there as well for the adjustment of at least one of the actuators, in order to adjust the rounding machine 4 to the metal sheet characteristic "thickness".

Figure 2:
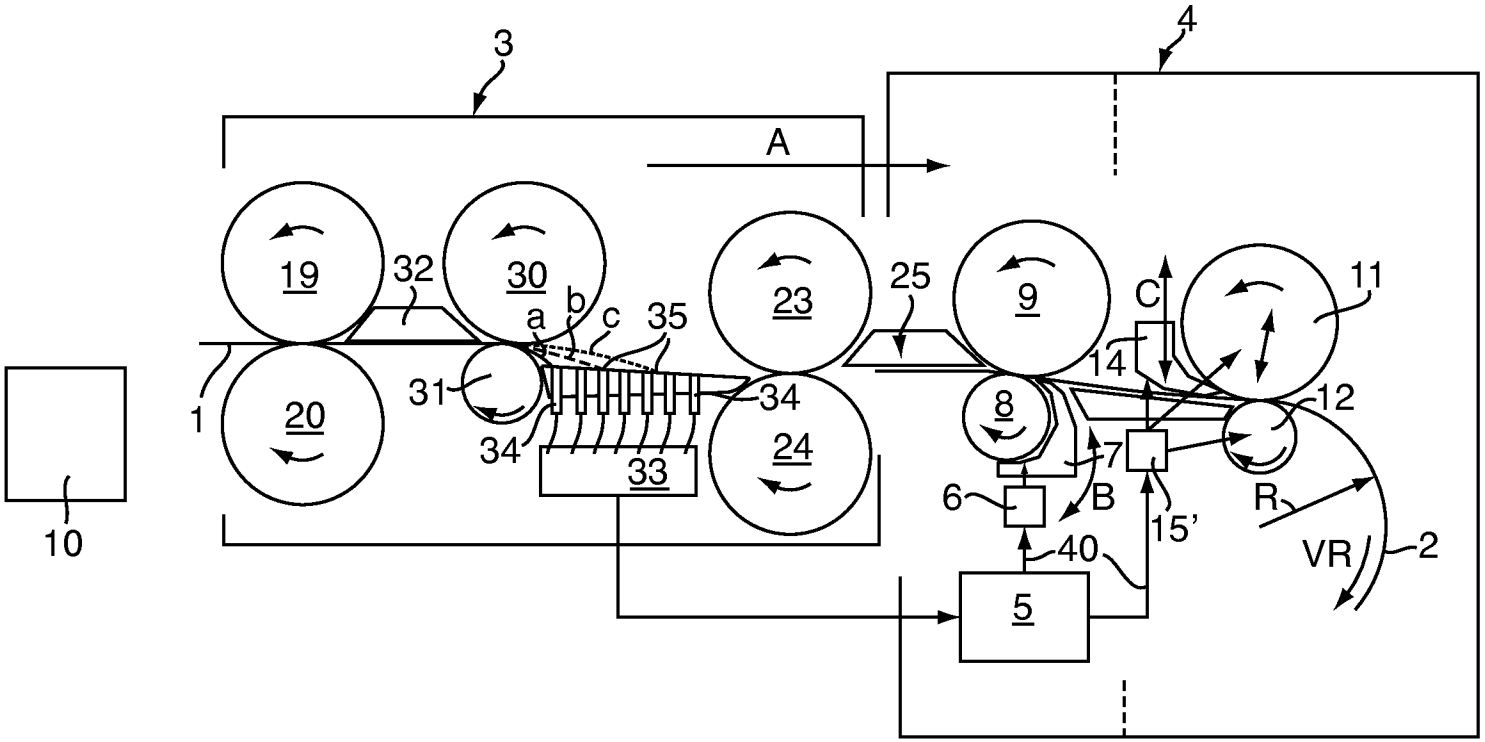
FIG. 2 schematically shows a device for the explanation of further embodiments of the invention.
Figure 3:
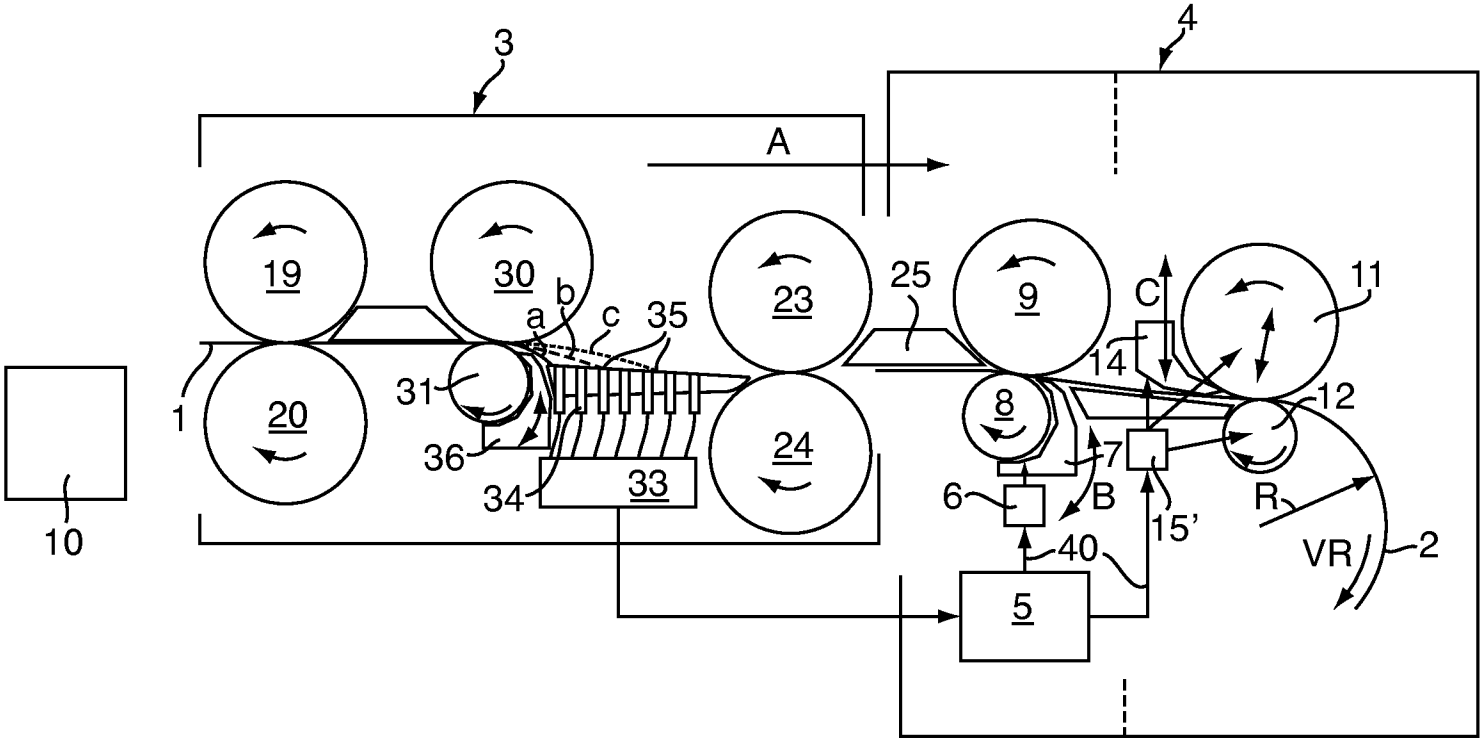
FIG. 3 schematically shows an embodiment similar to the one of FIG. 2 with a wedge at the measurement installation.

FIGS. 2 and 3 show further embodiments, for which same reference numerals again denote same elements. All considerations taken for the embodiments of FIG. 1 are also valid for the embodiments of the alternatives according to FIGS. 2 and 3. Also here, the controller 5 influences the rounding machine 4 by means of the actuators, if necessary inclusively the flexer station. In this embodiment, a pre-rounding is provided as measurement device, for which a part of the metal sheet section is rounded and the actual behaviour of this metal sheet section to this pre-rounding is measured. For the pre-rounding, the rollers 30 and 31 may for example be provided, to which usually a wedge 32 is provided upstream. The rollers are operated by an arrangement which is not shown, in such a way, that they cause a rounding only for a part of the metal sheet section, preferably for a front section, as shown in the figure. The metal sheet section may subsequently be straightened again. Three different possible rounding courses of a metal sheet are denoted in the figure by a, b and c and depicted with different line arts. By means of a measurement arrangement 33 to 35 it can be determined how the metal sheet section behaves in view of this measurement rounding. Thereby, for example a plurality of sensors 34 may be arranged in a linear sequence in traversing direction of the metal sheet. These sensors may react mechanically to touching or they may be electrical sensors which react based on the electrical conductivity of the metal sheet. They may particularly be electrical contacts, as this will be explained in more detail by means of FIGS. 4 to 6. The sensors may also be optical sensors, for example light barriers, or acoustic sensors, for example ultrasonic distance sensors. By means of the sensors it can particularly be determined, at which point of impact 35, or at which impact time the front edge of the metal sheet 1 impacts on the sensor arrangement, giving a measure for the rounding behaviour of the respective metal sheet or the course a or b or c respectively. The shape of the rounded area a, b, or c may as well be directly determined optically, by means of image processing or acoustically with distance measurement. The rounding behaviour of the metal sheet measured in this way during the pre-rounding is passed to the controller 5 as measurement value or derived value and serves there to adjust at least one of the actuators. In this embodiment the actuator 6 and a single actuator 15' is shown as well, which symbolizes the adjustment as well of the pre-rounding wedge 14 as of at least one of the rollers 11, 12 or the adjustment of the inclined positioning of the rollers respectively. Of course, a wedge 13 with a corresponding actuator may be provided here as well. Besides the measurement installation 33, an additional or both measurement installations 27, 28 described in connection with FIG. 1 may be provided. Equally, the measurement device 33 may be provided within the embodiment according to FIG. 1 or inside the rounding machine 4, for example in its flexer station. FIG. 3 shows an embodiment for which the aforementioned explanations are also valid and same reference numerals again denote same or similar elements. According to this embodiment, at the measurement device 33 there is also provided a wedge 36 analogous to the flexer wedge of the flexer station. This wedge 36 influences the pre-rounding measurement in a similar way as the flexer wedge influences the rounding, such that the measurement of the rounding characteristic is better adapted to the later rounding. Correspondingly, also the flexer wedge 36 is preferably adjusted by means of the actuator and the controller 5.

Figure 6:
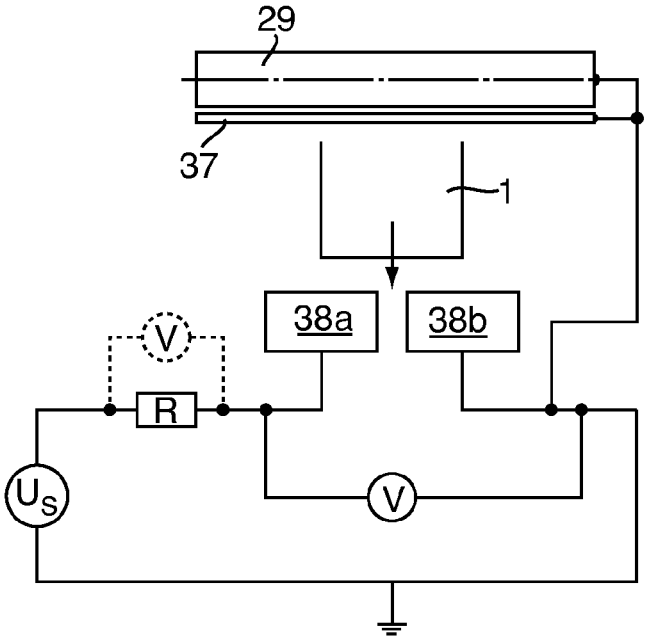
FIG. 6 is a representation of the electrical wiring of the measurement installation of FIGS. 4 and 5.

A preferred embodiment for determining the rounding behaviour of the respective metal sheet is explained by means of FIGS. 4 to 6. The respective measurement device 50 may be arranged, as it is the case for the previously described measurement devices 27 or 33 to 35 or 33 to 36, within the feed section 3. However, it may be arranged also within the actual rounding apparatus, particularly between the flexer station with the rollers 8, 9 and the flexer wedge 7; however, in this case it is preferably part of the flexer station or arranged in it respectively. In this way, the shown rollers 28 and 29 of the measurement device may replace the rollers 8 and 9 of the flexer station of the rounding apparatus or the rollers 31 and 30 in the feed section 3. For the preferred embodiment in view of space saving, the measurement device 50 is arranged within the rounding apparatus and the rollers 41 and 42 are therefore the rounding rollers (corresponding to the rounding rollers 11 and 12 of the previous examples) and therefore the elements described above or the wedges 14 and 13 of it respectively may be arranged before or after the rounding wedges 41, 42 respectively, indicated in FIG. 4 just by the rectangles 13 and 14. Also other placements before the rounding apparatus 4 or inside of it are evidently possible as well. In the shown example, the measurement device 50 has a flexer wedge 37. If the measurement installation is therefore placed in the feed section, according to the measurement device 33 to 36, the flexer wedge 37 may be adjusted in a way as the flexer wedge 7 within the rounding apparatus. If the measurement device is arranged in the rounding apparatus itself, and particularly in the flexer station, the flexer wedge 37 of the measurement installation directly takes over the function of the flexer wedge 7 of the rounding apparatus according to the previous examples as well, such that the rounding behaviour is measured with the flexer wedge. The measurement device 50 may however do without its flexer wedge 37. The measurement device has at least one sensor 45, by means of which the arrival of the respective metal sheet 1 at or in the measurement device 50 may be detected. Particularly the front edge in transport direction of the metal sheet is detected, particularly by means of an optical sensor, particularly a light barrier or multiple light barriers. This detection of the metal sheet 1 triggers a time measurement in the measurement device. This may take place by means of a separate time measurement means or by means of the aforementioned controller 5, and which in this case controls the measurement device or is part of the same respectively. This option is shown in FIG. 4. The time measurement is stopped when the front edge of the metal sheet impacts a measurement plate 38, which is transmitted to the controller 5 by means of a signal lead. As evident in FIG. 4 in side view, the time differs depending on the rounding behaviour and is therefore a measure for the rounding behaviour of the metal sheet. Therefore, by means of this measure, the rounding apparatus is subsequently controlled accordingly, as already described. This is indicated in FIG. 4 by means of the system of leads 40, which leads from the controller 5 in the way described above to the actuators of the rounding machine described above, in order to influence the rounding behaviour.

Figure 7:
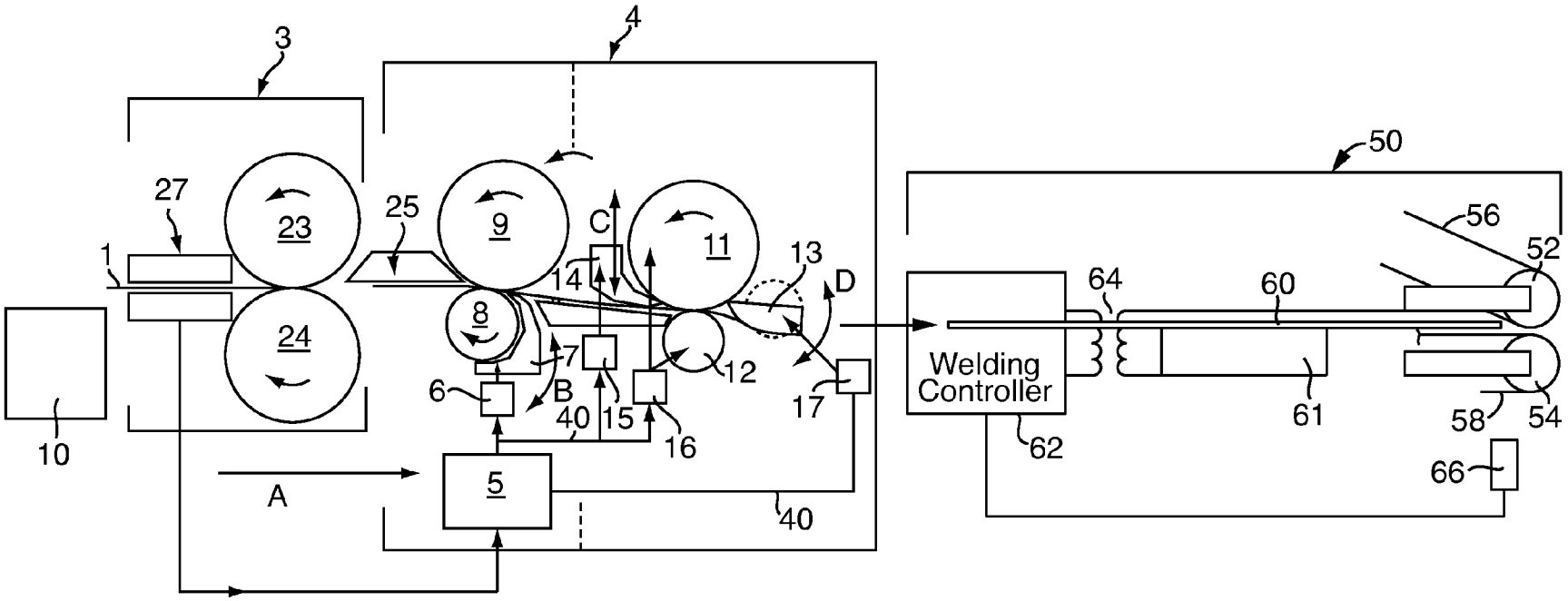

The detection of the impact of the front edge of the metal sheet onto the measurement plate 38 of the measurement device 50 preferably takes place electrically. This may occur in such a way, that the measurement plate has a first electrical potential and at least one of the rollers 28, 29 have another electrical potential (and, if present, also the flexer wedge 27 of the measurement installation has the potential of the roller). If the front edge of the electrically conductive metal sheet impacts the measurement plate 38, both potentials are being short-circuited, which can be detected by a corresponding current flow or a corresponding voltage drop of the measurement voltage. Thereby, the time measurement is stopped or the time between detection of the front edge by the sensor 45 and the impact of the front edge onto the measurement plate 38 and thereby the rounding of the metal sheet in the measurement device 50 are determined respectively. In case of coated metal sheets, the electric contact between the rollers 28, 29 and if necessary the flexer wedge 37 and the metal sheet may be insufficient. Because of this, the measurement plate 38 is preferably executed with a plurality of measurement parts 38*a*, 38*b*, 38*c*, 38*d* etc., which are electrically isolated from each other and lie side by side, which alternately also have the different electrical potentials. Thereby, the impact onto the measurement plate 38 can be electrically detected, also by short-circuiting such measurement parts by the front edge of the metal sheet, which is always uncoated. These parts may be formed wedge-shaped, as evident from FIGS. 4 and 5. FIG. 5 shows in graphical view a couple of the measurement wedges lying side by side. FIG. 6 shows a respective measurement circuit with a measurement voltage source US, whereby the rollers 28, 29 and the flexer wedge 37 have ground potential. The measurement wedges 38*b*, 38*d* etc. have also ground potential (in FIG. 6 only 38*b* is shown for reasons of simplicity). On the contrary, the measurement wedges 38*a*, 38*c* etc. have positive potential (in FIG. 6 only 38*a* is shown). The electrical short circuit possibilities for the measurement voltage by means of the impact of the metal sheet onto the measurement plate 38 are thereby located at the short-circuit measurement wedge—measurement wedge or measurement wedge—flexer wedge or measurement wedge—roller, wherein the measurement voltage drops in a detectable way and therefore stops the time measurement. The detection of the voltage drop is shown in FIG. 6 by means of the voltmeter symbols. FIG. 7 is a schematic for explaining some embodiments of the invention.

The method and device are particularly useful when welding can bodies.

Referring to FIG. 7, another embodiment of the present invention is shown. The embodiment shown in FIG. 7 includes a transport device 3, a rounding machine 4 and a welding device 50. The transport device 3 and the rounding machine 4 are similar to the transport device 3 and the rounding machine 4 shown in FIG. 1. The transport device 3 includes a roller pair 23, 24 and a measurement device 27 connected to a control installation 5 of the rounding machine 4, such that a measurement value or a derived value indicating a metal sheet characteristic can be passed to the controller 5, allowing the controller 5 of the rounding machine 4 to directly influence the rounding result or the rounding diameter respectively, during the operation, via the actuation of the actuators 6, 15, 16, 17 and thereby the setting of the thereby moved rollers 8, 9, 11, 12 and/ or rounding wedges 7, 13, 14. Additionally, as is discussed above, the welding device 50 is adapted to receive the rounded body blanks 61, which may be brought into contact with a Z-rail 60, where edges of the body blanks rounded from the sheet metal sections are placed into an overlapping or abutting relation and then to the welding rollers 52, 54 for welding by the wire electrodes 56, 58 that run over the rollers 52, 54, respectively.

While preferred embodiments of the invention are described in the present patent application, it is clearly noted that the invention is not limited to these embodiments but can also be carried out in different ways within the scope of the following claims.

The invention claimed is:

1. A method for rounding single metal sheet sections to form single container body blanks comprising:

feeding the single metal sheet sections from a stack to a rounding machine comprising a flexer station;

measuring at least one sheet metal characteristic that influences a rounding of the single metal sheet sections;

passing a value of the at least one sheet metal characteristic or a value derived therefrom to a controller of the rounding machine; and rounding the single metal sheet sections into the single container body blanks in the rounding machine, wherein the rounding machine is controlled based on the value of the at least one sheet metal characteristic or the value derived therefrom in such a way that a rounding diameter of the single container body blanks is held constant when the at least one metal sheet characteristic changes, wherein the at least one sheet metal characteristic is measured in a non-destructive way during the rounding of subsequent single metal sheet sections, wherein the at least one sheet metal characteristic is a rounding behaviour which is measured by a partial pre-rounding, and wherein the at least one sheet metal characteristic is measured in at least one of a feed section prior to entering the rounding machine, an entrance area of the rounding machine or the flexer station of the rounding machine.

2. The method according to claim 1, wherein the rounding takes place with a speed of 100 to 450 m/minute, and wherein the rounded single container body blanks are fed from the rounding machine into a welding device for can bodies with a Z-rail for the positioning of the body edges and welding rollers.

3. The method according to claim 1, wherein the at least one sheet metal characteristic is measured within the flexer station.

4. The method according to claim 1, wherein the at least one sheet metal characteristic is measured by at least one of electrical, mechanical, optical or acoustic means.

5. The method according to claim 4, wherein the at least one sheet metal characteristic is measured electrically by detecting a metal sheet in a predefined location during its pass, and by measuring a time until the metal sheet has electrical contact with a measurement plate.

6. The method according to claim 1, wherein the rounding machine comprises at least one rounding roller, and wherein each of the single metal sheet sections is acted upon by the at least one rounding roller during the step of measuring the at least one sheet metal characteristic.

7. The method according to claim 6, wherein the at least one rounding roller of the rounding machine is controlled based on the value of the at least one sheet metal characteristic or the value derived therefrom.

8. The method according to claim 1, wherein a pre-rounding wedge of the rounding machine is controlled based on the value of the at least one sheet metal characteristic or the value derived therefrom.

9. The method according to claim 1, wherein the flexer station of the rounding machine is controlled based on the value of the at least one sheet metal characteristic or the value derived therefrom.

10. A method for manufacturing can bodies from single metal sheet sections comprising:

feeding the single metal sheet sections from a stack via a feed section or directly to a rounding machine;

rounding the single metal sheet sections into rounded container body blanks in the rounding machine at a speed of 100 to 450 m/minute;

feeding the rounded container body blanks from the rounding machine into a welding device for can bodies, the welding device having a Z-rail for positioning of the body edges and welding rollers;

measuring at least one sheet metal characteristic which influences the rounding of the single sheet metal sections in at least one location selected from the group consisting of the feed section an entrance area of the rounding machine or a flexer station of the rounding machine, passing a value of the at least one sheet metal characteristic or a value derived therefrom to a controller of the rounding machine, and controlling the rounding machine based on the measurement value or the value derived therefrom such that rounding diameters of the rounded container body blanks are held constant when the at least one sheet metal characteristic changes, wherein the at least one sheet metal characteristic is a rounding behaviour of the single sheet metal sections, wherein the rounding behaviour is measured in a non-destructive way on subsequent metal sheet sections by a partial pre-rounding thereof, wherein the rounding behaviour is measured by at least one of electrical, mechanical, optical or acoustic means, wherein the rounding machine comprises at least one rounding roller and at least one flexer wedge, and wherein the metal sheet is acted upon during the measurement by the at least one rounding roller and the at least one flexer wedge.

11. A rounding machine for the rounding of single metal sheet sections comprising:

at least two rounding rollers;

at least one of a rounding wedge and a pre-rounding wedge as elements for rounding the single sheet metal sections;

at least one actuator for adjustably actuating at least one of the elements;

a controller;

a measuring device for measuring rounding behaviour of the single sheet metal sections by a partial pre-rounding; and means for adjusting the elements, wherein the rounding machine is provided for rounding the single sheet metal sections with a speed of 100 to 450 m/minute, wherein the measurement device is located in one of a feed section prior to entering the rounding machine, an entrance area of the rounding machine or a flexer station of the rounding machine, wherein the at least one of the elements is adjustable by the controller by means of the actuator, wherein the controller has an input for a measurement value of the rounding behaviour or a value derived therefrom, and wherein the measurement of the rounding behaviour is carried out during the rounding process at subsequent metal sheet sections in a non-destructive way.

12. The rounding machine according to claim 11, wherein the rounding behaviour measured by at least one of electrical, mechanical, optical or acoustic means.

13. The rounding machine according to claim 11, wherein the rounding behaviour measured electrically by carrying out a time measurement from a certain location by determining a time until the pre-rounded metal sheet has electrical contact with a measurement plate.

14. The rounding machine according to claim 13, wherein the measurement plate comprises multiple measurement parts which lie side by side and are electrically isolated from each other.

15. The rounding machine according to claim 11, wherein the metal sheet is acted upon during the measurement of the rounding behaviour by means of at least one of the rounding rollers or a flexer wedge following the rounding rollers.

16. A system for welding can bodies comprising:

a welding device for can bodies comprising a Z-rail for positioning can body edges, a plurality of welding rollers, and a rounding machine according to claim 11.

* * * * *

UNITED STATES PATENT AND TRADEMARK OFFICE

CERTIFICATE OF CORRECTION

PATENT NO. : 8,627,694 B2
APPLICATION NO. : 12/601533
DATED : January 14, 2014
INVENTOR(S) : Peter Schreiber It is certified that error appears in the above-identified patent and that said Letters Patent is hereby corrected as shown below:

In the Specification:

Column 3, after line 33, "FIG. 7 is a schematic for explaining some embodiments of the invention" should be added.

In the Claims:

Column 12, line 9, "a measuring device for measuring rounding behavior of" should be replaced with --a measuring device for measuring a rounding behaviour of--.

Signed and Sealed this
Twenty-second Day of July, 2014

Michelle K. Lee

Michelle K. Lee
*Deputy Director of the United States Patent and Trademark Office*